US010706795B2

(12) United States Patent
Xu et al.

(10) Patent No.: US 10,706,795 B2
(45) Date of Patent: Jul. 7, 2020

(54) DISPLAY PANEL DRIVING METHOD

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventors: Jing Xu, Shenzhen (CN); Taijiun Hwang, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 74 days.

(21) Appl. No.: 15/577,199

(22) PCT Filed: Oct. 24, 2017

(86) PCT No.: PCT/CN2017/107513
§ 371 (c)(1),
(2) Date: Nov. 27, 2017

(87) PCT Pub. No.: WO2019/037227
PCT Pub. Date: Feb. 28, 2019

(65) Prior Publication Data

US 2019/0057662 A1 Feb. 21, 2019

(30) Foreign Application Priority Data

Aug. 21, 2017 (CN) ..... 2017 1 0719822

(51) Int. Cl.
*G09G 3/36* (2006.01)
*G09G 3/20* (2006.01)

(52) U.S. Cl.
CPC ..... *G09G 3/3614* (2013.01); *G09G 3/20* (2013.01); *G09G 3/3677* (2013.01);
(Continued)

(58) Field of Classification Search
CPC ..... G09G 3/3614; G09G 3/20; G09G 3/3677; G09G 2310/0205; G09G 2310/021;
(Continued)

(56) References Cited

U.S. PATENT DOCUMENTS

2004/0183768 A1* 9/2004 Yamato ..... G09G 3/3614 345/98
2005/0174310 A1* 8/2005 Huang ..... G09G 3/3614 345/87
(Continued)

FOREIGN PATENT DOCUMENTS

CN 1532601 A 9/2004
CN 1556519 A 12/2004
(Continued)

*Primary Examiner* — Peter D McLoone
(74) *Attorney, Agent, or Firm* — Kirton McConkie; Evan R. Witt

(57) ABSTRACT

A display panel driving method is provided and has dividing all scan lines into two scan line sets, in a displaying time of each frame sequentially scanning a first scan line set and a second scan line set, and simultaneously applying data signals of opposite polarities to pixel units connected to the first scan line set and pixel units connected to the second scan line set.

14 Claims, 5 Drawing Sheets

(52) U.S. Cl.
CPC ..... *G09G 2310/021* (2013.01); *G09G 2310/0205* (2013.01); *G09G 2310/0213* (2013.01); *G09G 2310/0267* (2013.01); *G09G 2310/0281* (2013.01); *G09G 2310/0283* (2013.01); *G09G 2330/021* (2013.01)

(58) Field of Classification Search
CPC ... G09G 2310/0213; G09G 2310/0267; G09G 2310/0281; G09G 2310/0283
See application file for complete search history.

(56) References Cited

U.S. PATENT DOCUMENTS

| | | | | |
|---|---|---|---|---|
| 2009/0237345 | A1 | 9/2009 | Kamada | |
| 2010/0097366 | A1* | 4/2010 | Kitayama ..... | G09G 3/3614 345/213 |
| 2017/0061912 | A1* | 3/2017 | Kitayama ..... | G09G 3/3614 |

FOREIGN PATENT DOCUMENTS

| | | | |
|---|---|---|---|
| CN | 101546542 | A | 9/2009 |
| CN | 101669162 | A | 3/2010 |

* cited by examiner

DISPLAY PANEL DRIVING METHOD

FIELD OF THE INVENTION

The present invention relates to the field of displaying technologies, especially to a display panel driving method.

BACKGROUND OF THE INVENTION

With development of displaying technologies, structures and functions of display panels of mobile devices such as cellular phones have become more and more diversified. Meanwhile, people's requirements to display panels have become more and more strict. To meet public demands, display panel manufacturers adjust designs of display panels. To increase quality and reliability of display panels, other performances thereof are downgraded.

For example, to solve issues of afterimages and screen flickering brought by residual direct current of a display panel, conventional technologies drive a display panel by polarity inversion. Common polarity inversion types include frame inversion, point inversion, column inversion, row inversion, etc. Current display panels usually employ the point inversion and column inversion. However, frequently inverting the polarity results in increased power consumption of the display panel and further influences stand-by time of the display device.

Therefore, it is necessary to provide a display panel driving method to solve issues of conventional technologies.

SUMMARY OF THE INVENTION

An objective of the present invention is to provide a display panel driving method that ensures displaying effect of a display panel while lowering the power consumption of the display panel.

To solve the aforementioned issues, a preferred embodiment of the present invention provides a display panel driving method. The display panel has multiple scan lines, multiple data lines, and multiple pixel units defined by the scan lines and the data lines, all of the scan lines are divided into two scan line sets, and the display panel driving method comprises:

in a displaying time of each frame, sequentially scanning the first scan line set and the second scan line set, and simultaneously applying data signals of opposite polarities to the pixel units connected to the first scan line set and the pixel units connected to the second scan line set;

wherein in the displaying time of each frame, applying the data signals of opposite polarities to the pixel units connected to the first scan line set and the pixel units connected to the second scan line set further specifically comprises: in the displaying time each frame, applying a data signal having the polarity inverted one time to each data line;

wherein the scan lines comprise odd row scan lines and even row scan lines, the first scan line set comprises all of the odd row scan lines, and the second scan line set comprises all of the even row scan lines.

In the display panel driving method of the present invention, in a displaying time of a same frame, the data signals applied to two adjacent data lines have an identical polarity.

In the display panel driving method of the present invention, in a displaying time of a same frame, the data signals applied to two adjacent data lines have opposite polarities.

In the display panel driving method of the present invention, in the displaying time of each frame, sequentially scanning the first scan line set and the second scan line set specifically comprises:

in the displaying time of each frame, sequentially scanning the scan lines of the first scan line set row by row; and in the displaying time of each frame, sequentially scanning the scan lines of the second scan line set row by row.

In the display panel driving method of the present invention, each pixel unit is connected to one scan line and one data line.

To solve the above issues, the preferred embodiment of the present invention also provides a display panel driving method, the display panel having multiple scan lines, multiple data lines, and multiple pixel units defined by the scan lines and the data lines, all of the scan lines are divided into two scan line sets, and the display panel driving method comprises:

in a displaying time of each frame, sequentially scanning the first scan line set and the second scan line set, and simultaneously applying data signals of opposite polarities to the pixel units connected to the first scan line set and the pixel units connected to the second scan line set.

In the display panel driving method of the present invention, in a displaying time of a same frame, the data signals applied to two adjacent data lines have an identical polarity.

In the display panel driving method of the present invention, in a displaying time of a same frame, the data signals applied to two adjacent data lines have opposite polarities.

In the display panel driving method of the present invention, in a same column of the pixel units, the data signals applied to two adjacent pixel units have opposite polarities.

In the display panel driving method of the present invention, in the displaying time of each frame, sequentially scanning the first scan line set and the second scan line set specifically comprises:

in the displaying time of each frame, sequentially scanning the scan lines of the first scan line set row by row; and in the displaying time of each frame, sequentially scanning the scan lines of the second scan line set row by row.

In the display panel driving method of the present invention, in the displaying time of each frame, applying the data signals of opposite polarities to the pixel units connected to the first scan line set and the pixel units connected to the second scan line set specifically comprises:

in the displaying time of each frame, applying a data signal having the polarity inverted one time to each data line.

In the display panel driving method of the present invention, the scan lines comprise odd row scan lines and even row scan lines, the first scan line set comprises all of the odd row scan lines, and the second scan line set comprises all of the even row scan lines.

In the display panel driving method of the present invention, each pixel unit is connected to one scan line and one data line.

In comparison to the prior art, advantageous effects of the present invention are as follows. By dividing all of the scan lines into two scan line sets, and in a displaying time of each frame, sequentially scanning the first scan line set and the second scan line set, and simultaneously applying data signals of opposite polarities to the pixel units connected to the first scan line set and the pixel units connected to the second scan line set, low flickering and extremely reduced power consumption are assured when the display panel is driven by a row inversion driving or point inversion driving method.

To make the abovementioned contents of the present invention easier to understand, preferred embodiments with appended figures will be explained in details as follows.

DETAILED DESCRIPTION OF THE PREFERRED EMBODIMENTS

Figure 1:
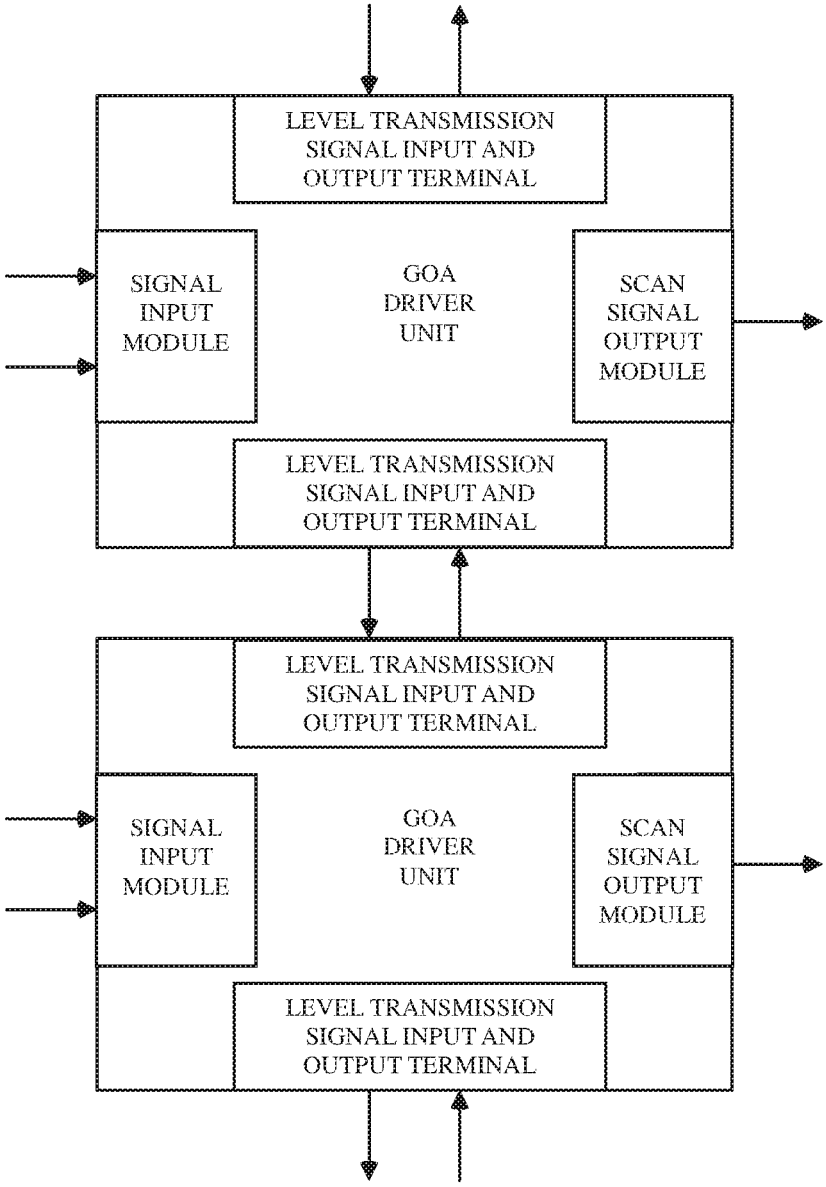
FIG. 1 PRIOR ART
FIG. 1 is a block diagram of multiple gate-driver-on-array (GOA) driver units of a conventional GOA driver circuit in accordance with the prior art.

Disclosed specific structures and detailed functions herein are merely representative and are configured for purposes of describing exemplary embodiments of the present invention. However, the present invention may be embodied in many alternative forms and should not be explained to be limited by the described embodiments herein.

In descriptions of the present invention, it should be understood that orientation relations or position relations indicated by terminologies "central", "lateral", "upper", "lower", "left", "right", "vertical", "horizontal", "top", "bottom", "inner", "outer", etc. are based on the orientation relations or position relations indicated by appending drawings and are described briefly for the purposes of facilitating descriptions of the present invention only, instead of indicating or implying the specified devices or elements necessarily having the specific orientations and positions, and constructed and operating with the specific orientations and positions. Therefore, the abovementioned cannot be comprehended as limitations to the present invention. Therefore, terminologies "first" and "second" are for the purposes of descriptions only and cannot be comprehended as indications or implies of relative importance or number of the indicated features. Thus, a feature limited by "first" or "second" explicitly or implicitly comprises one or more of the feature. In the descriptions of the present invention, unless another explanation else is presented, the meaning of "multiple" is two or more. Furthermore, a terminology "comprise" and any variants thereof mean to cover non-exclusively "comprise".

In the descriptions of the present invention, it is should be explained that unless clear rules or limitations are presented, terminologies "install", "couple", "connect" should be interpreted generally. For example, the above terminologies may refer to secure connection, detachable connection or integral connection, may refer to mechanical connection or electrical connection, and may refer to direct connection, indirect connection by an intervening medium or internal communication between two elements. A person of ordinary skill in the art, it is understood can specifically understand the specific meanings of the above terminologies in the present invention.

The terminologies used herein are for the purposes of describing the specific embodiments and are not intended to limit the exemplary embodiments. Unless otherwise clearly referred to in the context, singular forms "a", "an" used herein is intended to comprise plurality. It is should be understood that terminologies "comprise" and/or "include" used herein specify existence of the described feature, integer, step, operation, unit and/or assembly without excluding existence or addition of one or more other feature, integer, step, operation, unit and/or assembly.

In the figures, units in similar structures are marked with identical reference numerals.

FIG. 1 is a block diagram of multiple gate-driver-on-array (GOA) driver units of a conventional gate-driver-on-array (GOA) driver circuit in accordance with the prior art. As shown in the figure, each GOA unit is disposed with a signal input module, a scan signal output module and a level transmission signal input and output terminal. By passing a level transmission signal through two adjacent GOA units, forward scanning and backward scanning to pixel units of each row of a display panel are implemented, as shown in FIGS. 2 and 3.

Figure 2:
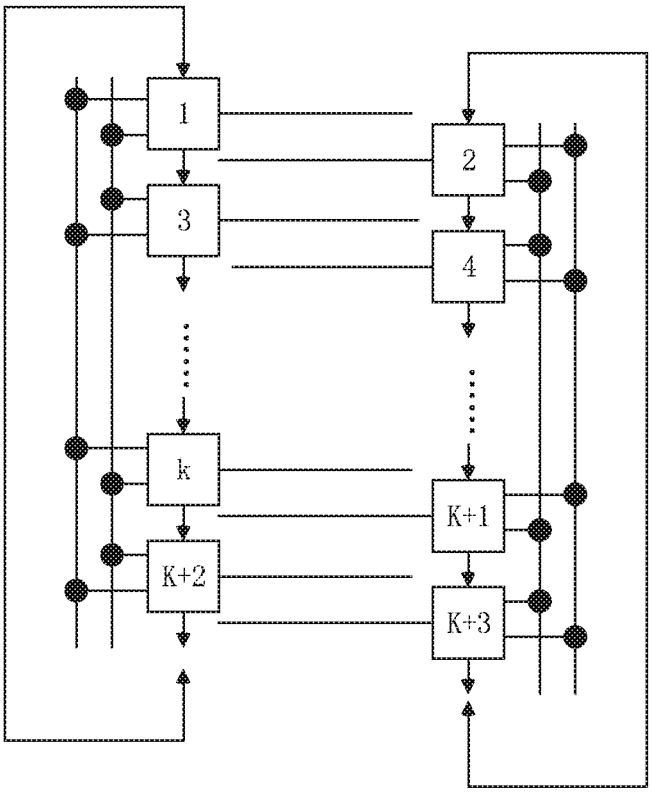
FIG. 2 PRIOR ART
FIG. 2 is a schematic view of forward scanning of conventional interlaced scan activation in accordance with the prior art.
Figure 3:
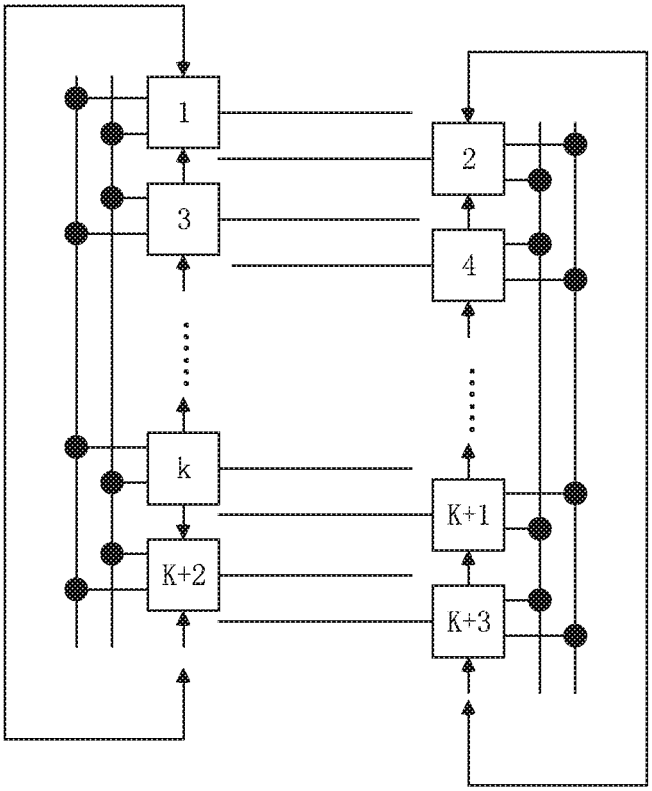
FIG. 3 PRIOR ART
FIG. 3 is a schematic view of backward scanning of the conventional interlaced scan activation in accordance with the prior art.

FIG. 2 is a schematic view of forward scanning of conventional interlaced scan activation in accordance with the prior art. FIG. 3 is a schematic view of backward scanning of the conventional interlaced scan activation in accordance with the prior art. Multiple GOA driver circuits are disposed respectively on left and right sides of a display region. The GOA driver circuits disposed on the left side are configured to drive the pixel units of odd rows, and the GOA driver circuits disposed on the right side are configured to drive the pixel units of even rows.

When scanning is implemented, with reference to FIG. when forward scanning is implemented, the first GOA driver unit disposed on the left side scan-drives the pixel units of a first row. At the next timing, a first GOA driver unit disposed on the right side scan-drives the pixel units of a second row. At the next timing, a second GOA driver unit disposed on the left side scan-drives the pixel units of a third row. At the next timing, a second GOA driver unit disposed on the right side scan-drives the pixel units of a fourth row. The above steps of scan-driving are circulated repeatedly. When backward scanning is implemented, the scanning process is similar to the aforementioned forward scanning process, as shown in FIG. 3, and will not be described in details again.

Furthermore, it is easy to understand that when the display panel is driven by the aforementioned forward and backward scanning methods, to implement row inversion or point inversion, each data line, when transferred from an odd row to an even row, needs to change polarity of data signals transmitted thereby. Such change of polarity extremely consumes the driver chips.

It is necessary to explain that the display panel has multiple scan lines, multiple data lines, and multiple pixel units defined by the scan lines and the data lines. Each pixel unit is connected to a scan line and a data line. In the embodiment of the present invention, all of the scan lines are divided into two scan line sets that are a first scan line set and a second scan line set. Next, in a displaying time of each frame, the first scan line set and the second scan line set are sequentially scanned, and the pixel units connected to the first scan line set and the pixel units connected to the second scan line set are simultaneously applied with data signals of opposite polarities. Specifically, the pixel units connected to the scan lines of the same scan line set has identical polarity to reduce frequency of the polarity inversion of the data signals such that the power consumption is lowered. Detailed explanation will be described as follows.

Figure 4:
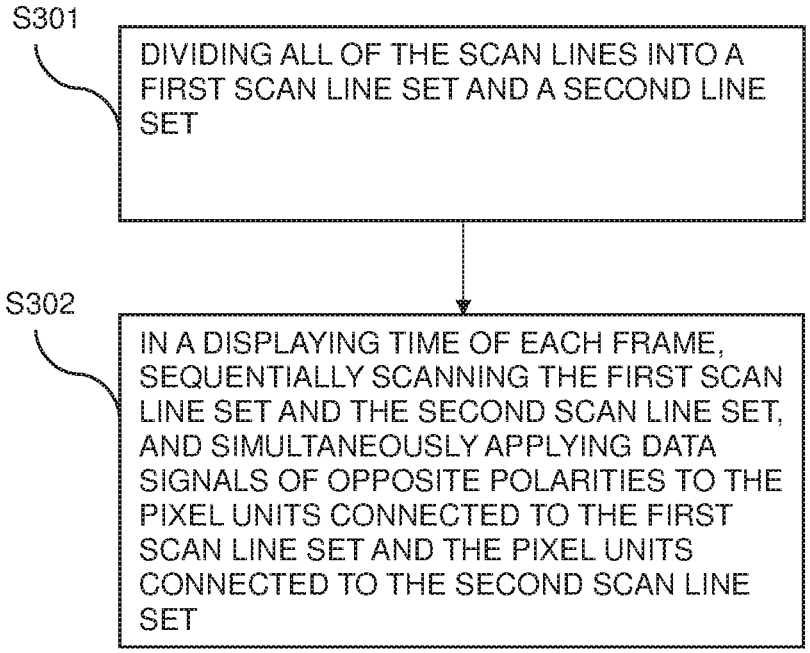
FIG. 4 is a flowchart of a display panel driving method of an embodiment in accordance with the present invention.

FIG. 4 is a flowchart of a display panel driving method of an embodiment in accordance with the present invention. As shown in the figure, the display panel driving method comprises:

step S301, dividing all of the scan lines into two scan line sets; and step S302, in a displaying time of each frame, sequentially scanning the first scan line set and the second scan line set, and simultaneously applying data signals of opposite polarities to the pixel units connected to the first scan line set and the pixel units connected to the second scan line set.

The step S301 further comprises dividing all of the scan lines into two scan line sets that are a first scan line set and a second scan line set. The first scan line set comprises all odd row scan lines, and the second scan line set comprises all even row scan lines.

Figure 5:
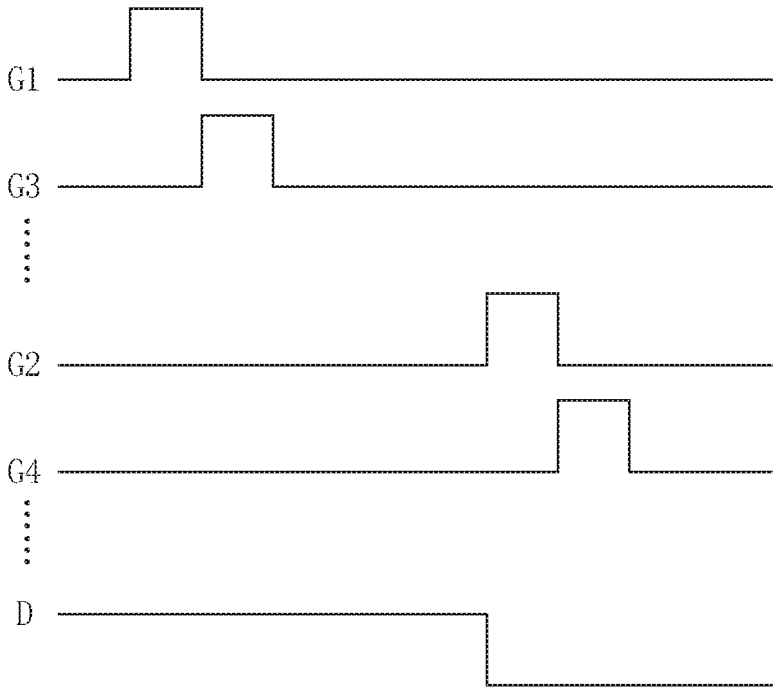
FIG. 5 is a timing diagram of a preferred embodiment in accordance with the present invention.

In the step S302, with reference to FIG. 5, FIG. 5 is a timing diagram of the display panel driving method of the preferred embodiment of the present invention. As shown in the figure, the step S302 further comprises in the displaying time of each frame, sequentially scanning the first scan line set and the second scan line set.

In the displaying time of each frame, sequentially scanning the first scan line set and the second scan line set specifically comprises:

in the displaying time of each frame, sequentially scanning the scan lines of the first scan line set row by row; and in the displaying time of each frame, sequentially scanning the scan lines of the second scan line set row by row.

Specifically, the first GOA driver unit disposed on the left side is utilized to scan-drive the scan lines of a first row. At the next timing, the second GOA driver unit disposed on the left side is utilized to scan-drive the pixel units of a third row. At the next timing, a third GOA driver unit disposed on the left side is utilized to scan-drive the pixel units of a fifth row, so on and so forth, until the all the odd row scan lines are scan-driven. Next, the first GOA driver unit on the right side is utilized to scan-drive the scan line of the second row. At the next timing, the second GOA driver unit disposed on the left side is utilized to scan-drive the scan line of a fourth row. At the next timing, the third GOA driver unit disposed on the left side is utilized to scan-drive the scan line of a sixth row, so on and so forth, until all the even row scan lines are scan-driven.

It is necessary to explain that the present invention may drive the second scan line set first and then drive the first scan line set. The present invention is intended to open the scan lines connected to the pixel units of the same polarity first to further avoid constantly changed polarity of the data signals applied to the data lines resulting in increasing power consumption.

Furthermore, the pixel units connected to the first scan line set and the pixel units connected to the second scan line set are applied with data signals of opposite polarities. With respect to a row inversion driving method, in a displaying time of the same frame, the data signals applied to two adjacent data lines have an identical polarity. With respect to a point inversion driving method, in a displaying time of the same frame, the data signals applied to two adjacent data lines have opposite polarities. In the row or point inversion driving method, in the pixel units of the same row, the data signals applied to two adjacent pixel units have opposite polarities.

Specifically, in a displaying time of each frame, applying the data signals of opposite polarities to the pixel units connected to the first scan line set and the pixel units connected to the second scan line set, specifically comprises: in the displaying time of each frame, applying a data signal having the polarity inverted one time to each data line.

By dividing all of the scan lines into two scan line sets, and in a displaying time of each frame, sequentially scanning the first scan line set and the second scan line set, and simultaneously applying data signals of opposite polarities to the pixel units connected to the first scan line set and the pixel units connected to the second scan line set, the display panel driving method of the preferred embodiment assures low flickering and extremely reduced power consumption are when the display panel is driven by a row inversion driving or point inversion driving method.

The present invention also provides a display panel driven by the abovementioned driving method. Details thereof may refer to the aforementioned descriptions and will not be repeated herein.

The present invention also provides a display device comprising the abovementioned display panel. Details thereof may refer to the aforementioned descriptions and will not be repeated herein By dividing all of the scan lines into two scan line sets, and in a displaying time of each frame, sequentially scanning the first scan line set and the second scan line set, and simultaneously applying data signals of opposite polarities to the pixel units connected to the first scan line set and the pixel units connected to the second scan line set, the display panel, the driving method thereof and the display device thereof of the present invention assure low flickering and extremely reduced power consumption are when the display panel is driven by a row inversion driving or point inversion driving method.

Although the present invention has disclosed the preferred embodiments as above, the abovementioned preferred embodiments are not intended to limit the present invention. A person of ordinary skill in the art may makes any changes and modifications without departing from the spirit and scope of the present invention. Therefore, the protection scope of the present invention is based on the scope of the claims.

What is claimed is:

1. A display panel driving method, wherein a display panel has multiple scan lines, multiple data lines, and multiple pixel units defined by the scan lines and the data lines, all of the scan lines are divided into two scan line sets that are a first scan line set and a second scan line set, the display panel driving method comprising:

in a displaying time of each frame, sequentially scanning the first scan line set and the second scan line set, and simultaneously applying data signals of opposite polarities to the pixel units connected to the first scan line set and the pixel units connected to the second scan line set, wherein the sequentially scanning the first scan line set and the second scan line set comprises:

in the displaying time of each frame, sequentially scanning the scan lines of the first scan line set row by row; and in the displaying time of each frame, sequentially scanning the scan lines of the second scan line set row by row; and in the displaying time of each frame, both the first scan line set and the second scan line are scanned simultaneously instead of being scanned in different halves of a time respectively;

wherein in the displaying time of each frame, applying the data signals of opposite polarities to the pixel units connected to the first scan line set and the pixel units connected to the second scan line set further comprises: in the displaying time of each frame, applying a data signal having a polarity inverted one time to each data line; and wherein the scan lines comprise odd row scan lines and even column scan lines, the first scan line set comprises all of the odd row scan lines, and the second scan line set comprises all of the even row scan lines;

wherein in a displaying time of a same frame, the data signals applied to two adjacent data lines have a same polarity.

2. The display panel driving method as claimed in claim 1, wherein in a displaying time of a same frame, the data signals applied to two adjacent data lines have opposite polarities.

3. The display panel driving method as claimed in claim 2, wherein in a same column of the pixel units, the data signals applied to two adjacent pixel units have opposite polarities.

4. The display panel driving method as claimed in claim 1, wherein in a same column of the pixel units, the data signals applied to two adjacent pixel units have opposite polarities.

5. The display panel driving method as claimed in claim 1, wherein in a same column of the pixel units, the data signals applied to two adjacent pixel units have opposite polarities.

6. The display panel driving method as claimed in claim 1, wherein each pixel unit is connected to one scan line and one data line.

7. A display panel driving method, wherein a display panel has multiple scan lines, multiple data lines, and multiple pixel units defined by the scan lines and the data lines, all of the scan lines are divided into two scan line sets that are a first scan line set and a second scan line set, and the display panel driving method comprises:

in a displaying time of each frame, sequentially scanning the first scan line set and the second scan line set, and simultaneously applying data signals of opposite polarities to the pixel units connected to the first scan line set and the pixel units connected to the second scan line set, wherein sequentially scanning the first scan line set and the second scan line set comprises:

in the displaying time of each frame, sequentially scanning the scan lines of the first scan line set row by row; and in the displaying time of each frame, sequentially scanning the scan lines of the second scan line set row by row; and in the displaying time of each frame, both the first scan line set and the second scan line are scanned simultaneously instead of being scanned in different halves of a time respectively;

wherein in a displaying time of a same frame, the data signals applied to two adjacent data lines have a same polarity.

8. The display panel driving method as claimed in claim 7, wherein in a displaying time of a same frame, the data signals applied to two adjacent data lines have opposite polarities.

9. The display panel driving method as claimed in claim 8, wherein in a same column of the pixel units, the data signals applied to two adjacent pixel units have opposite polarities.

10. The display panel driving method as claimed in claim 7, wherein in a same column of the pixel units, the data signals applied to two adjacent pixel units have opposite polarities.

11. The display panel driving method as claimed in claim 7, wherein in a same column of the pixel units, the data signals applied to two adjacent pixel units have opposite polarities.

12. The display panel driving method as claimed in claim 7, wherein in the displaying time of each frame, applying the data signals of opposite polarities to the pixel units connected to the first scan line set and the pixel units connected to the second scan line set comprises:

in the displaying time of each frame, applying a data signal having the polarity inverted one time to each data line.

13. The display panel driving method as claimed in claim 7, wherein the scan lines comprise odd row scan lines and even column scan lines, the first scan line set comprises all of the odd row scan lines, and the second scan line set comprises all of the even row scan lines.

14. The display panel driving method as claimed in claim 7, wherein each pixel unit is connected to one scan line and one data line.

* * * * *